US005758787A

United States Patent [19]

Sheu

[11] Patent Number: 5,758,787

[45] Date of Patent: Jun. 2, 1998

[54] NURSING ASSEMBLY FOR INFANT

[76] Inventor: Miin-Shiou Sheu, No. 156, Cheng Kung Road, Chang Hua City, Taiwan

[21] Appl. No.: 804,827

[22] Filed: Feb. 24, 1997

[51] Int. Cl.[6] ..... A61J 11/04; A61J 9/00

[52] U.S. Cl. ..... 215/11.1; 215/11.3; 215/387; 215/388

[58] Field of Search ..... 215/11.1, 11.3, 215/11.6, 387, 388

[56] References Cited

U.S. PATENT DOCUMENTS

| | | | |
|---|---|---|---|
| 2,446,451 | 8/1948 | Allen | 215/11.1 |
| 2,448,569 | 9/1948 | Allen | 215/11.1 |
| 2,497,197 | 2/1950 | Allen | 215/11.1 |
| 2,497,198 | 2/1950 | Allen | 215/11.1 |
| 2,599,630 | 6/1952 | Hair . | |
| 3,851,781 | 12/1974 | Marco | 215/11.3 |
| 5,038,948 | 8/1991 | Signorini | 215/11.1 |

*Primary Examiner*—Sue A. Weaver
*Attorney, Agent, or Firm*—Beveridge, DeGrandi, Weilacher & Young LLP

[57] ABSTRACT

A nursing assembly of the type which can be readily installed with a standard nipple socket includes a cup, a nipple socket, a collar socket and a locking socket. The locking socket includes an extension which can be engaged with a skirt portion of the collar socket. In assembling, a cup is disposed within the collar socket such that the outer rim of the cup is seated onto a top portion of a lower stepped portion of the collar socket. Accordingly, the wall portion of the cup is protected and supported by the skirt portion of the collar socket. Then the locking collar is screwed onto the collar socket such that the extension is inserted into the cup. By this arrangement, the wall of cup is sandwiched by the skirt portion and the extension of the collar socket and the locking socket and complete protection and support is attained without the possibility of deforming or unintended release from the locking socket and collar socket.

19 Claims, 3 Drawing Sheets

NURSING ASSEMBLY FOR INFANT

BACKGROUND OF THE INVENTION

The present invention relates to a nursing assembly, more particularly, to a nursing assembly which can be readily attached to the opening of a disposable cup which is readily available from the store. When a baby is coming with parent for traveling, the nursing units shall be always accompanied since the baby shall be fed frequently. By the provision of the present invention, the disposable cup can be readily used as a container for serving liquid food, such as the juice and milk. Afterward, this paper cup can be discarded and a new cup can be used, consequently, the parent may prepare the meal in a more convenient and efficient way without washing, sterilizing a used bottle. By this arrangement, the necessity of bringing a plurality of bottles for many a meals can be therefore eliminated. Besides, the cup made from paper is environmental friendly which will not cause a problem of recycling. In light of this, by the provision of the nursing assembly made according to the present invention, the parent can feed their infant or baby in a more easy way.

DESCRIPTION OF PRIOR ART

The bottle is the main utensil for feeding an infant or a baby with liquid food, such as the juice, milk and/or water. Since each time the baby takes a small volume of meal, it shall be fed frequently. Accordingly, when a baby is brought for traveling, many a bottles shall be brought for the each meal. In order to reduce the possibility of being infected by bacteria, the bottle shall be sterilized with boiling water or steam before it is used. Only when the bottle is treated with such procedures can the baby be fed in a safe environment. Nevertheless, it is out of image of bringing such a complete set of sterilizing device for traveling. In light of this, the main concern needs to be solved for bringing a baby for traveling is the sterilizing of the bottles. This is really a headache for the parents.

U.S. Pat. No. 2,599,630, Disposable Feeding Bottle For Babies (hereinafter referred to as '630), issued on Jun. 10, 1952 has provided a nursing unit wherein a disposable paper bottle can be incorporated for nursing a baby during the traveling. The parent can readily feed their baby with a readily available paper bottle without the inconvenience of washing and sterilizing an used bottle. By the provision of this nursing unit, the parent can readily feed their baby in an easy way. Nevertheless, in this typical nursing unit, it can be concluded with the following defects and which shall be solved sooner or later. The numerals used in the following description are identical to those used in the attached specification of said '630 patent.

1. In order to readily attach to the opening of the container, a nipple with special configuration shall be made. Accordingly, the manufacturing cost will be considerably increased as a result of the complicated configuration of the nipple. As the cost is comparatively high, the society may not receive and enjoy the convenience provided by this invention.

2. The nipple used in the '630 patent has a tailored design which can not be replaced or interchanged with other standard nipples used on the ordinary bottles. As the nipple can not be readily replaced with a standard nipple, it brings an inconvenience to the parent because a lot of special and standard nipples shall be prepared for different bottles in different meals.

3. If this disposable nursing unit is used frequently, a lot of disposable paper cup/bottles will be used and which will also cause a great expense to a family. Accordingly, this bottle is only used on traveling. Nevertheless, when the baby is familiar with a typical bottle, especially on the nipple or the accessories, such as an automatic straw, it is hard to replace this bottle with a new one. If the bottle/nipple is not the type of which the baby is familiar with, the baby may refuse to be fed.

4. In the nursing unit disclosed in the '630 patent, the upper and lower brackets are interlocked together with threads engagement. Nevertheless, the engagement portion is limited in the flange portion and outer rim of the bottle. As a matter of fact, an infant can not manipulate the assembly in a controlled way. When an excess gripping force is applied to the bottle and which may have already be softened by the liquid food contained therein, such as hot milk, the flange portion of the cup will be readily released from the engagement. If this disengagement is occurred, a leakage will be happened. If this disengagement is increased, at last, the cup will be completely released from the upper bracket. If this is indeed happened, the baby will be injured by the heated liquid food and this should be avoided in any case.

SUMMARY OF THE INVENTION

It is the objective of the present invention to provide a nursing assembly which can be readily attached to the bottle made from paper or other material.

In order to achieve the objective set forth, the nursing set made according to the present invention generally comprises a cup/bottle made from paper, a nipple bracket, a collar socket and a locking ring. The collar socket has a stepped shoulders which defines a cone shape receiving space therein. The upper portion of the shoulder has been provided with a threaded portion and the flange portion of the lower portion provides a seat for the outer rim portion of a cup. By this arrangement, the cup can be removably retained within the collar socket with its upper portion. The locking collar has a hollow configurational wherein the standard nipple can be readily and removably retained thereof The locking collar is provided with a threaded socket for receiving and retaining a standard nipple assembly thereon. The bottom of the locking collar is provided with a cup locking portion having outer threaded portion to be engaged with the collar socket. The bottom is provided with an extension to be meshed with a skirt portion of the collar socket. By this arrangement, when the locking collar is screwed onto the collar socket, the extension may readily inserted into the cup such that the wall of the cup can be supported by the skirt portion and the extension as the wall of the cup is sandwiched therebetween. Accordingly, the cup served as a container can be readily supported and protected without deforming or escaping from the locking collar and collar socket. Even excess force is applied to the cup, the wall will also not be removed therefrom. The leaking problems resulted from excess lock-up and/or incorrect attachment encountered by the conventional nursing unit are completely solved. On the other hand, many a standard cup can be used as a container for containing liquid food. No special container is requested. In light of this, the nursing assembly provided by the present invention provides functions of convenience, versatility and hygienic.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
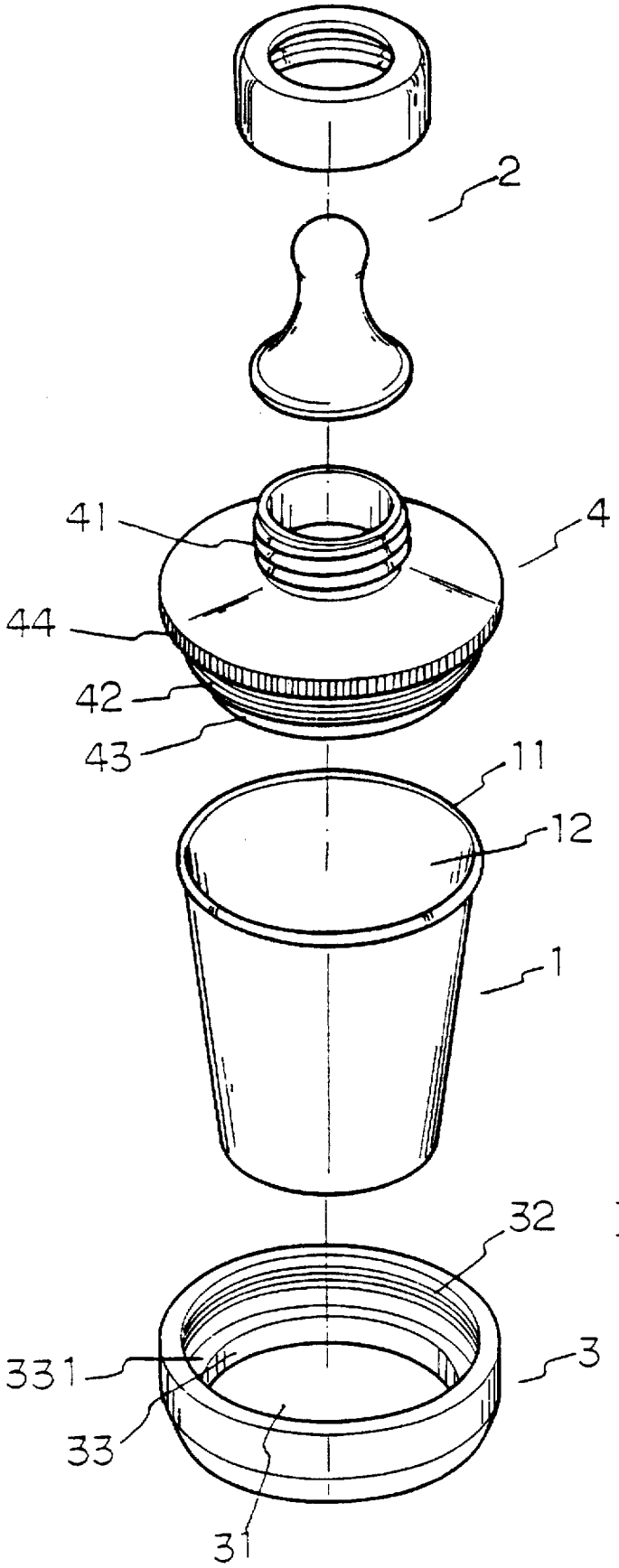
FIG. 1 is an exploded perspective view of the nursing assembly made according to the present invention.
Figure 2:
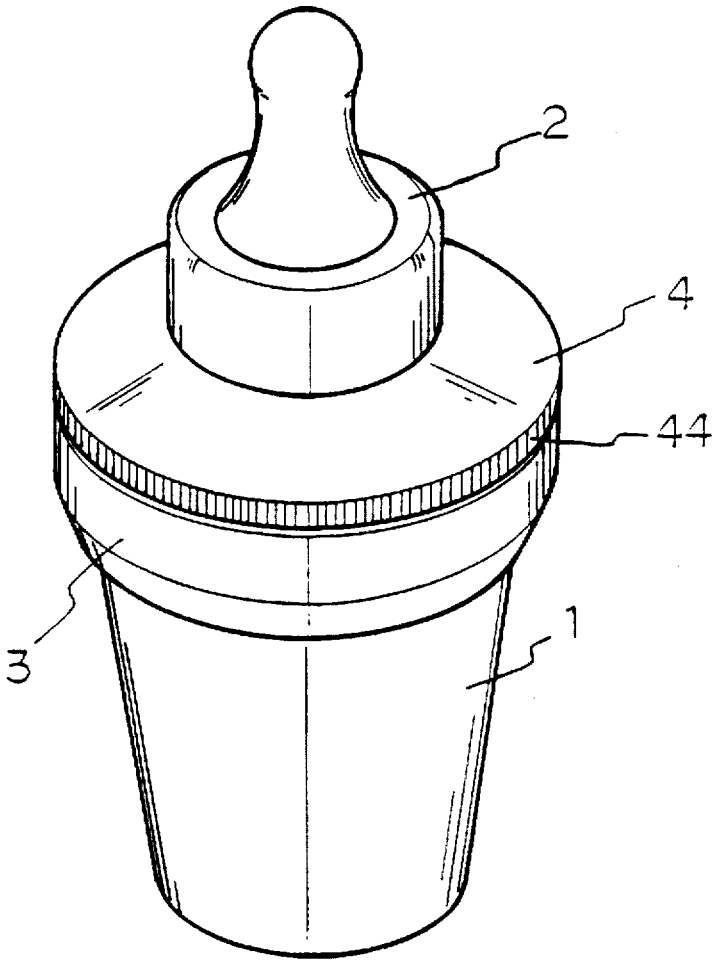
FIG. 2 is a perspective view of the nursing assembly made according to the present invention.
Figure 3:
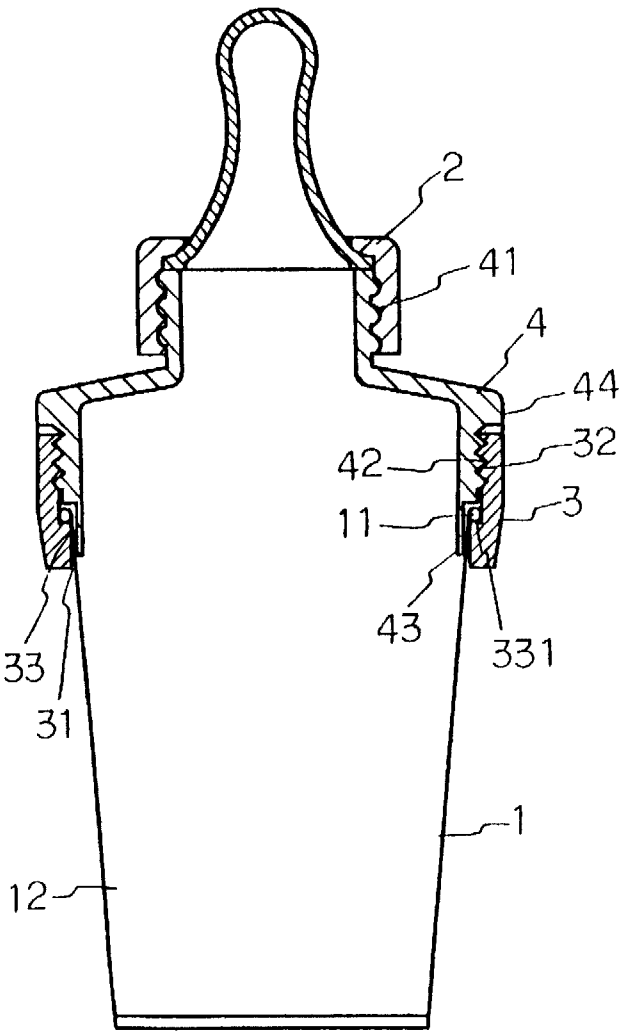
FIG. 3 is a cross sectional view of the nursing assembly made according to the present invention.

Referring to FIGS. 1, 2, and 3, the nursing assembly made according to the present invention generally comprises a cup 1 made from paper, a conventional nipple socket 2, a collar socket 3, and a locking socket 4.

The collar socket 3 has a cone shape configuration defining a stepped shoulders inner space thereof The bottom of the socket 3 is provided with an opening 31. The upper portion of the stepped shoulder is provided with threaded portion 32 and the lower portion or skirt portion 33 is provided with a flange 331 which in turn provides a seat for the outer rim 11 of a paper cup 1. By this arrangement, the upper portion of the cup 1 is removably retained within the collar socket 3.

The locking socket 4 is a hollow locking body having a plurality of frictional patterns at the outer peripheral. Grooved section 44 is provided to assist with rotation. The top of the locking socket 4 is provided with a nipple locking threaded portion 41 for retaining a standard nipple socket 2 atop. The bottom of the locking socket 4 is provided with a cup locking threaded portion 42 to be meshed with the threaded portion 32 of the collar socket 3. The locking socket 4 further includes an extension 43 which can be engaged with the skirt portion 33 of the collar socket 3 and can be extended into the inner space of a cup 1 to clamp outer rim 11 of the cup 1.

Referring to FIG. 3, the extension 43 of the locking collar 4 is extended into the inner wall 12 of the cup 1 and which provides a complete protection and support to the upper portion of the cup I together with the skirt portion 33 of the collar socket 3. Since the outer rim 11 of the cup 1 can be completely seated onto the flange 331 of the skirt portion 33 of the locking collar 3, a complete water-tight effect can be attained. By this arrangement, the cup 1 will not be disengaged or released from resulted from excess gripping force.

Figure 4:
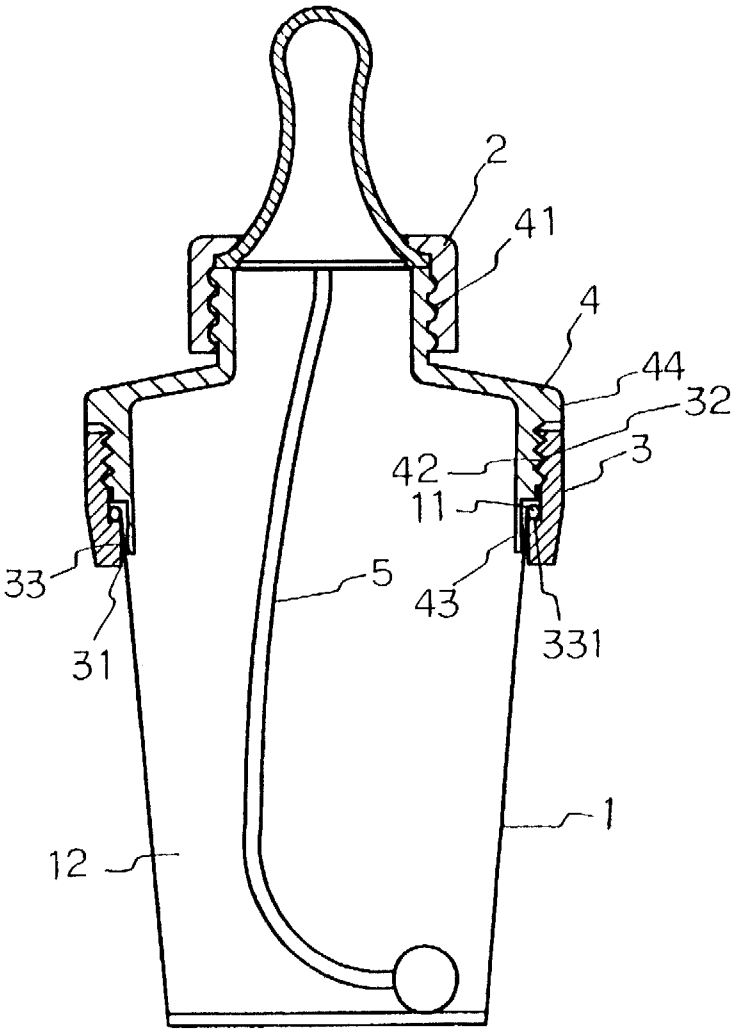
FIG. 4 is still a cross sectional view of the nursing assembly made according to the present invention.

Besides, the locking threaded portion 41 can be installed with a nipple socket 2 or even mounted with an automatic straw 5, as shown in FIG. 4. In light of this, no tailored design is required for this nursing assembly. Consequently, the infant will not be stuck in only one or two nipples. The leaking problems resulted from excess lock-up and/or incorrect attachment encountered by the conventional nursing unit are completely solved. On the other hand, many a standard cup can be used as a container for containing liquid food. No special container is required and the used cup can be readily discarded as it is environmental friendly. In light of this, the nursing assembly provided by the present invention provides functions of convenience, versatility and hygienic. Besides, it is also very compact which reduces the space required for storage.

While particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

I claim:

1. A nursing assembly for use with a cup, comprising:

a locking socket having a first threaded portion extending radially outward and having an extension member extending below a bottom end of said first threaded portion, an outer radial surface of said extension member defining a first engaging surface; and a collar socket having a second threaded portion extending radially inward and having a lower portion extending below a bottom end of said second threaded portion, said lower portion having a skirt portion extending radially inward in relation to said second threaded portion, said skirt portion defining a top flanged surface and an inner radial surface, said inner radial surface of said skirt portion defining a second engaging surface, wherein said first threaded portion of said locking socket is rotatably engaged with said second threaded portion of said collar socket, said bottom end of said first threaded portion of said locking socket, a portion of said first engaging surface and said top flanged surface at least partially define a radial cup rim containing chamber, and said first engaging surface and said second engaging surface are relatively positioned to engage an inner and an outer periphery, respectively, of a cup wall.

2. The nursing assembly defined by claim 1, wherein:

said locking socket includes a nipple member at one end thereof.

3. The nursing assembly defined by claim 2, wherein:

said nipple member includes a straw member extending in said nursing assembly.

4. The nursing assembly defined by claim 1, wherein:

said first engaging surface and said second engaging surface sandwich a cup wall such that fluid communication is prevented therebetween.

5. The nursing assembly defined by claim 1, wherein:

said first engaging surface and said second engaging surface are the sole means for preventing fluid communication between said locking socket and said collar socket.

6. The nursing assembly defined by claim 1, wherein:

said locking socket has a nipple connecting opening defined therethrough.

7. The nursing assembly defined by claim 6, further comprising:

a nipple member and a nipple member locking ring, said nipple member locking ring having a threaded portion, wherein, said locking socket further includes a nipple connecting threaded portion, said threaded portion of said nipple member locking ring being engaged with said nipple member and being rotatably engaged with said nipple connecting threaded portion of said locking socket such that said nipple member is fixed to said locking socket and is in fluid communication with said nipple connecting opening.

8. The nursing assembly defined by claim 7, wherein:

said nipple member includes a straw member extending in said nursing assembly.

9. The nursing assembly defined by claim 1, wherein:

an outer periphery of said collar socket defines a gripping portion for holding said nursing assembly.

10. The nursing assembly defined by claim 1, wherein:

said locking socket and said collar socket are dimensioned and sized to be engaged with a disposable cup to form a nursing container.

11. The nursing assembly defined by claim 1, wherein:

said locking socket includes a nipple member at one end thereof, said nipple member includes a straw member extending into said nursing assembly said first engaging surface and said second engaging surface sandwich a cup wall such that fluid communication is prevented therebetween, said first engaging surface and said second engaging surface are the sole means for preventing fluid communication between said locking socket and said collar socket, an outer periphery of said collar socket defines a gripping portion for holding said nursing assembly, and said locking socket and said collar socket are dimensioned and sized to be engaged with a cup to form a nursing container.

12. The nursing assembly defined by claim 1, further comprising:

a nipple member and a nipple member locking ring, wherein said nipple member locking ring has a threaded portion, said locking socket defines a nipple connecting opening therethrough and includes a nipple connecting threaded portion, said threaded portion of said nipple member locking ring being engaged with said nipple member and being rotatably engaged with said nipple connecting threaded portion of said locking socket such that said nipple member is fixed to said socket and is in fluid communication with said nipple connecting opening, said nipple member includes a straw member extending in said nursing assembly, said first engaging surface and said second engaging surface sandwich a cup wall such that fluid communication is prevented therebetween, said first engaging surface and said second engaging surface are the sole means for preventing fluid communication between said locking socket and said collar socket, an outer periphery of said collar socket defines a gripping portion for holding said nursing assembly, and said locking socket and said collar socket are dimensioned and sized to be engaged with a cup to form a nursing container.

13. A nursing container, comprising:

a cup having an inner wall, an outer wall and an upper rim;

a locking socket having a first threaded portion extending radially outward and having an extension member extending below a bottom end of said first threaded portion, an outer radial surface of said extension member defining a first engaging surface; and a collar socket having a second threaded portion extending radially inward and having a lower portion extending below a bottom end of said second threaded portion, said lower portion having a skirt portion extending radially inward in relation to said second threaded portion, said skirt portion defining a top flanged surface and an inner radial surface, said inner radial surface of said skirt portion defining a second engaging surface, wherein said first threaded portion of said locking socket is rotatably engaged with said second threaded portion of said collar socket, said upper rim is disposed in a chamber defined at least in part by said bottom end of said first threaded portion of said locking socket, a portion of said first engaging surface and said top flanged surface, and said first engaging surface and said second engaging surface are in sealing engagement with said inner wall and said outer wall, respectively, of said cup.

14. The nursing container defined by claim 13, wherein:

said cup comprises a paper cup.

15. The nursing container defined by claim 14, wherein:

said paper cup comprises a disposable paper cup.

16. The nursing container defined by claim 15, wherein:

said locking socket includes a nipple member at one end thereof, said first engaging surface and said second engaging surface sandwich said inner and said outer walls of said cup such that fluid communication is prevented therebetween, said first engaging surface and said second engaging surface are the sole means for preventing fluid communication between said locking socket and said collar socket, and an outer periphery of said collar socket defines a gripping portion for holding said nursing assembly.

17. The nursing assembly defined by claim 13, wherein:

said cup comprises a plastic cup.

18. The nursing assembly defined by claim 17, wherein:

said plastic cup comprises a disposable plastic cup.

19. The nursing assembly defined by claim 18, wherein:

said locking socket includes a nipple member at one end thereof, said first engaging surface and said second engaging surface sandwich said inner and said outer walls of said cup, respectively, such that fluid communication is prevented therebetween, said first engaging surface and said second engaging surface are the sole means for preventing fluid communication between said locking socket and said collar socket, and an outer periphery of said collar socket defines a gripping portion for holding said nursing assembly.

* * * * *